US008026462B2

(12) United States Patent
Arnold et al.

(10) Patent No.: US 8,026,462 B2
(45) Date of Patent: Sep. 27, 2011

(54) FASTENING ELEMENT FOR ATTACHING A PART TO A SUPPORTING ELEMENT

(75) Inventors: Reiner Arnold, Burgthann (DE); Alwin Neukamm, Wilhermsdorf (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 501 days.

(21) Appl. No.: 12/161,841

(22) PCT Filed: Oct. 11, 2006

(86) PCT No.: PCT/EP2006/009788

§ 371 (c)(1),
(2), (4) Date: Nov. 13, 2008

(87) PCT Pub. No.: WO2007/082563

PCT Pub. Date: Jul. 26, 2007

(65) Prior Publication Data

US 2009/0120927 A1 May 14, 2009

(30) Foreign Application Priority Data

Jan. 23, 2006 (DE) ..... 10 2006 003 319

(51) Int. Cl.
*H05B 3/68* (2006.01)
*A47G 29/00* (2006.01)

(52) U.S. Cl. ..... 219/451.1; 248/215

(58) Field of Classification Search .... 219/443.1–468.2; 248/200, 205.1, 207, 215, 216.1, 216.4, 220.21, 248/221.11–222.11, 225.21
See application file for complete search history.

(56) References Cited

U.S. PATENT DOCUMENTS

| | | | | |
|---|---|---|---|---|
| 3,056,012 | A | 9/1962 | Hanson | |
| 3,128,479 | A * | 4/1964 | Juergens | 4/619 |
| 3,183,341 | A | 5/1965 | Hanson | |
| 3,368,780 | A * | 2/1968 | Buttriss | 248/27.3 |
| 4,988,149 | A | 1/1991 | Mulder et al. | |
| 5,410,128 | A | 4/1995 | Vermillion et al. | |

FOREIGN PATENT DOCUMENTS

| | | |
|---|---|---|
| DE | 9010754 U | 9/1990 |
| DE | 19835140 A1 | 2/2000 |
| DE | 10306813 A1 | 8/2004 |
| GB | 2277146 A | 10/1994 |

OTHER PUBLICATIONS

Catalogue: Mecano Speed Nuts (2nd ed.), pp. 29-1 and 29-7, Mecano-Simmonds GmbH, Postfach, Germany.

* cited by examiner

*Primary Examiner* — Sang Paik
(74) *Attorney, Agent, or Firm* — Workman Nydegger

(57) ABSTRACT

A fastening element for attaching a part such as a cooking hob to a supporting element, such as a frame supporting/surrounding the cooking hob, can include a spring secured to the supporting element. In one implementation, the fastening element can be secured by engaging a locking element of the spring into a first recess in the supporting element. In the mounted state, the spring has at its free end a gripping portion for holding the part, and the spring being embodied, as an element which is bent in a leaf-shaped manner. For ease in mounting the spring, the spring can have at the other end a width-reduced end that can penetrate a second slit-shaped recess in the supporting element. The width-reduced end and the slit-shaped recess are narrower than the region of the spring that is bent in a leaf-shaped manner.

20 Claims, 3 Drawing Sheets

FASTENING ELEMENT FOR ATTACHING A PART TO A SUPPORTING ELEMENT

BACKGROUND OF THE INVENTION

1. Field of the Invention

The invention relates to a fastening element for attaching a part, especially a cooking hob, to a supporting element, in particular to a frame supporting and/or surrounding the cooking hob, the fastening element comprising a spring which can be secured to the supporting element by engaging a locking element which is disposed on the spring into a first recess in the supporting element, the spring having at its one end which is free in the mounted state a gripping portion for holding the part and the spring being embodied as an element which is bent in a leaf-shaped manner.

2. Background and Relevant Art

Fastening elements of this type are used during the installation of a cooking hob in a worktop. This involves inserting into recesses in the supporting element, i.e. in the support frame, during the mounting process a number of springs which are formed from a leaf-shaped material strip, which each have a gripping portion and which, when mounted, hold the cooking hob. In order to secure the spring in the support frame, the recess in the support frame and the spring end opposing the free spring end are shaped relative to each other so as to allow the spring to be secured in a defined position on the support frame.

In order to prevent the spring from falling out in the mounted position, a lug-like projection, which engages into a corresponding recess in the support frame and thus secures the spring, is stamped on in an end portion of the spring metal sheet.

The mounting of the spring and the cooking hob on the support frame is complex insofar as auxiliary means must be used in order to be able to mount the spring on the support frame. For this purpose, use is typically made of a pressing device or a hammer which allows the spring to be pressed or struck into its end position.

BRIEF SUMMARY OF THE INVENTION

The invention is therefore based on the object of developing a fastening element of the type mentioned at the outset so as to allow simpler mounting, if possible without auxiliary means, wherein the securing of the spring in the mounted state should nevertheless be ensured with absolute reliability.

The solution provided by the invention to this object is characterized in that the spring of the fastening element has at the other end which is remote from its free end a width which is reduced in relation to the width of the region of the spring that is bent in a leaf-shaped manner, the width-reduced end penetrating in the mounted state of the spring a second slit-shaped recess in the supporting element, the width of the second slit-shaped recess being smaller than the non-reduced width of the region of the spring that is bent in a leaf-shaped manner.

This configuration allows the width-reduced end region of the spring to insert during mounting into the second slit-shaped recess. The aforementioned relationships of the widths of the portion of the spring that is bent in a leaf-shaped manner, of the width-reduced end portion of the spring and of the slit-shaped recess produce for the spring, once it has been inserted into the slit-shaped recess, a pivot axis about which the spring can be tilted into its mounting end position until it secures its locking element in this position.

It is thus easily possible without tools to carry out the mounting and nevertheless to obtain a very reliable fit of the spring.

A first further development provides for the spring to consist of a strip-like piece of spring steel or spring sheet metal.

Advantageously, the locking element which is disposed on the spring is formed from the material of the spring.

A preferred embodiment allows the locking element to be formed by a portion which is punched out of the material of the spring and bent out of the plane of the metal sheet. In this case, the locking element can have a widening in its end region which is remote from the basic element of the spring. This widening is preferably T-shaped in its embodiment so, once the locking element has locked into the first recess, a secure, hook-like closure is obtained.

The first and the second slit-shaped recess in the supporting element can merge and form a single material cutout in the supporting element. Furthermore, provision may in this case be made for the first recess to be embodied in a semicircular shape adjoining the second slit-shaped recess. The diameter of the semicircle is in this case particularly preferably between 25% and 70% of the width of the second slit-shaped recess.

Effective guidance of the spring in the recess in the supporting element is ensured if the reduced width of the end which is remote from the free end of the spring is between 75% and 90% of the width of the region of the spring that is bent in a leaf-shaped manner.

In its mounted state, the spring abuts the supporting element particularly well if, in a development, provision is made for the end which is remote from the free end of the spring to be disposed offset relative to the region of the spring that is bent in a leaf-shaped manner in the normal direction of the region. The offset is in this case preferably between 0.5 mm and 2.0 mm; it can correspond to the thickness of the supporting element. Advantages in terms of production are obtained if the offset is generated by a process of reshaping the spring metal sheet which is flat in its initial state.

The proposal of the invention allows the spring of the fastening element to be mounted in a very simple manner without the need for mounting tools. Nevertheless, in the mounted state, the spring sits very securely in the recesses in the supporting element, thus ensuring a secure hold.

BRIEF DESCRIPTION OF THE DRAWINGS

An exemplary embodiment of the invention is illustrated in the drawings, in which.

DETAILED DESCRIPTION OF THE PREFERRED EMBODIMENTS

Figure 1:
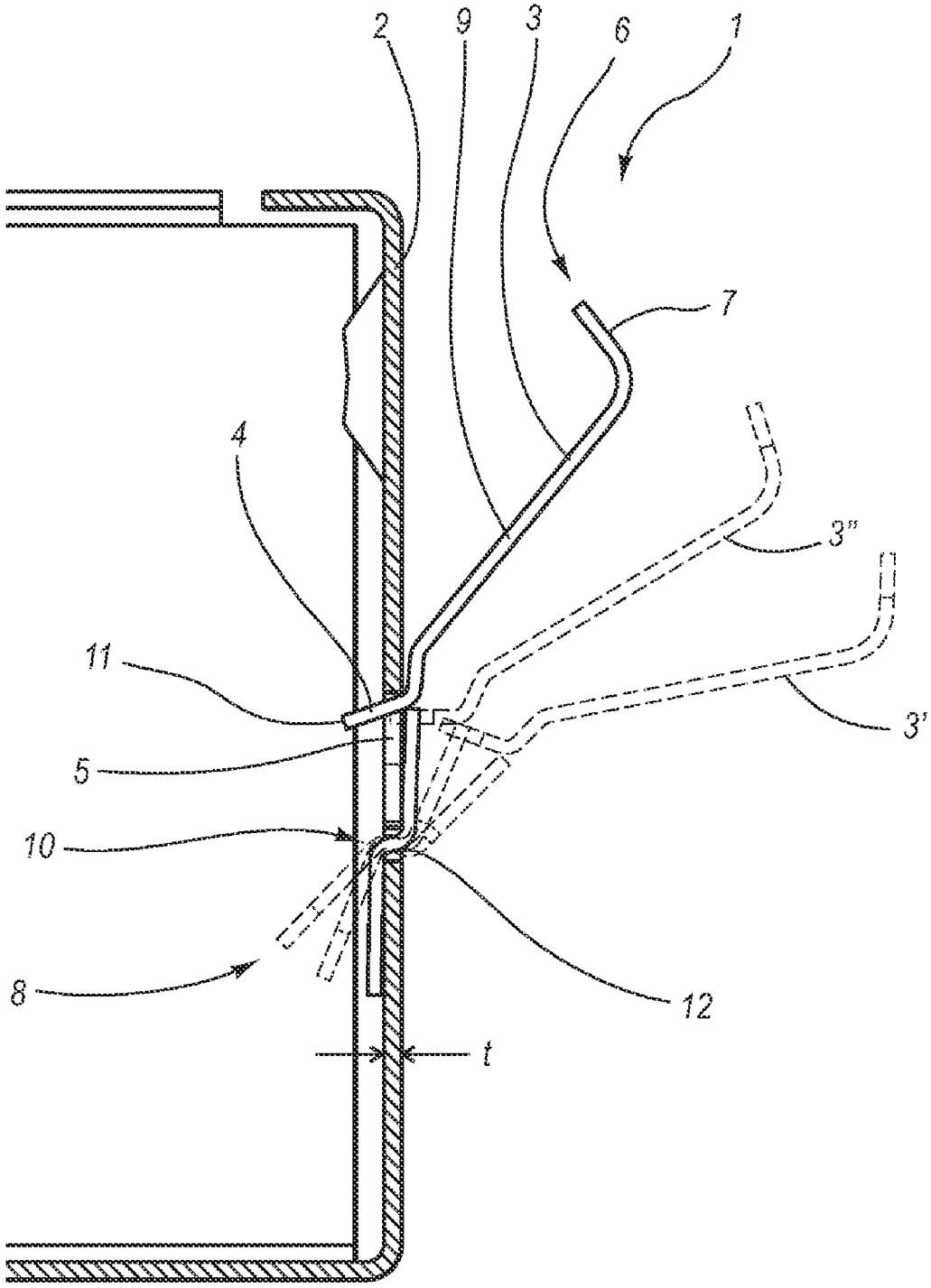
FIG. 1 is a cross section through a supporting element comprising a fastening element.

FIG. 1 shows the embodiment of a fastening element 1 which is provided to fix a cooking hob (not shown) in a fixing element 2 which, in particular, forms (also) a protective casing for the cooking hob. The basic component of the fastening element 1 is a spring 3 which is produced from a strip of spring sheet metal, i.e. has a flat initial contour. The spring 3 has a region 9 which is bent in a leaf-shaped manner (see FIG.

2) and which forms the largest extension of the spring 3. This region 9 which is bent in a leaf-shaped manner has a constant metal sheet width B. At one (upper) end 6, the spring 3 has a gripping portion 7 which is bent in such a way that it holds the cooking hob (not shown) in its mounted position.

The other (lower) end 8 of the spring 3 is fixed to the supporting element 2. For this purpose, the supporting element 2 has two recesses 5 and 10. In the present case, the two recesses 5, 10 merge with each other, i.e. they form a single cutout from the material of the supporting element 2. As may be seen most clearly in FIG. 3, but also in FIG. 4, the first recess 5 is semicircular in shape. The diameter of the semicircle is denoted by D. The second recess 10, which has a slit-shaped form, adjoins the recess 5.

Of crucial importance are the width relationships between the region 9 of the spring 3 that is bent in a leaf-shaped manner, the fixed end 8 of the spring 3 and the slit-shaped recess 10:

The width B of the region 9 of the spring 3 that is bent in a leaf-shaped manner is larger than the width BS of the second slit-shaped recess 10. However, the width BS of the second slit-shaped recess 10 is, in turn, larger than the width b of the fixed end 8 of the spring 3.

This allows the (in the mounted state) fixed end 8 of the spring 3 to be inserted or slid into the slit 10 until the start of the region 9 which is bent in a leaf-shaped manner rests against the recess 10. In FIG. 1, this position of the spring 3 during the mounting process is indicated by broken lines and the spring 3 is denoted in this position by reference numeral 3'. During the mounting of the spring 3 on the supporting element 2, the spring 3 is then pivoted about the resulting axis 12 (see FIGS. 1 and 3) in such a way that the spring 3 enters—via the position 3" according to FIG. 1—the mounting end position indicated by fixed lines.

Figure 2:
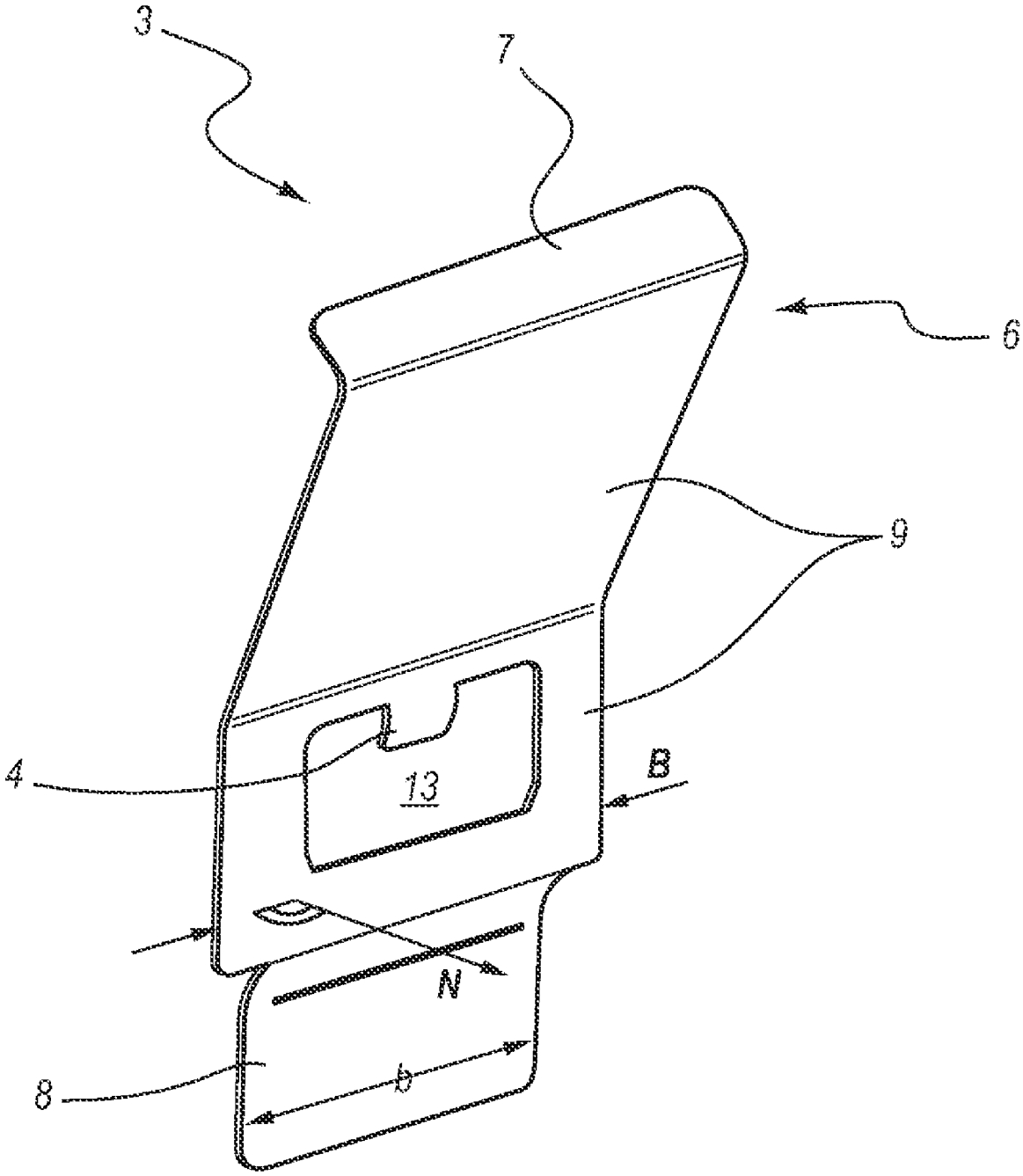
FIG. 2 is a perspective view of the spring of the fastening element.

In order to secure the spring 3 in the mounting end position, a substantially rectangular window 13 is punched out of the basic element of the spring 3 (see FIG. 2), although the punching process is carried out in such a way that there remains in the window 13 a strip-like projection which is then bent out of the plane of the metal sheet (i.e. in the normal direction N, see FIG. 2), thus forming a locking element 4.

Figure 3:
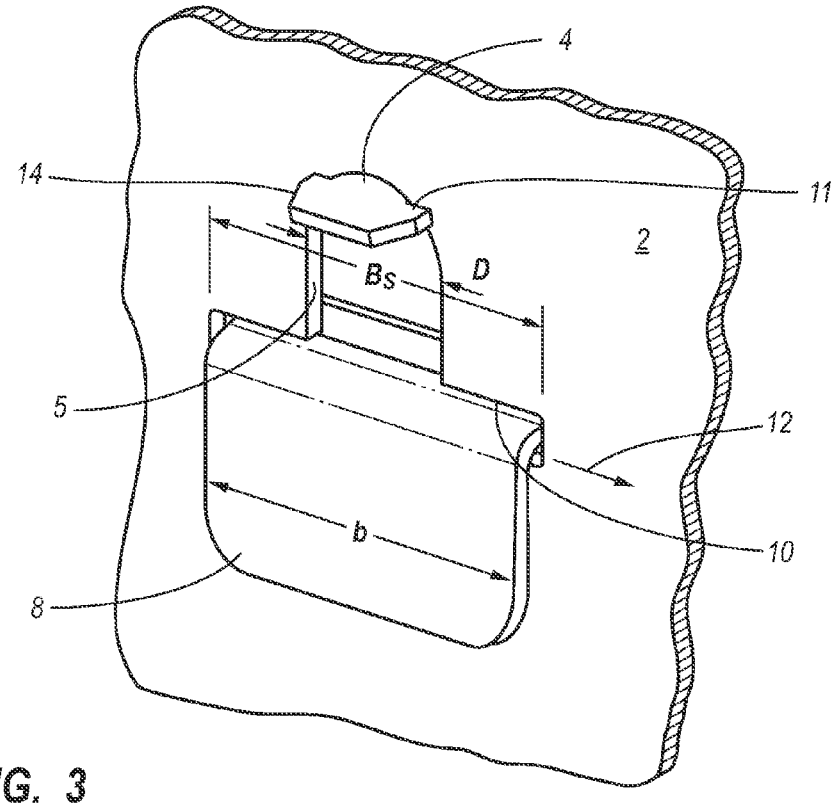
FIG. 3 is a perspective view of a portion of the supporting element with the spring mounted.
Figure 4:
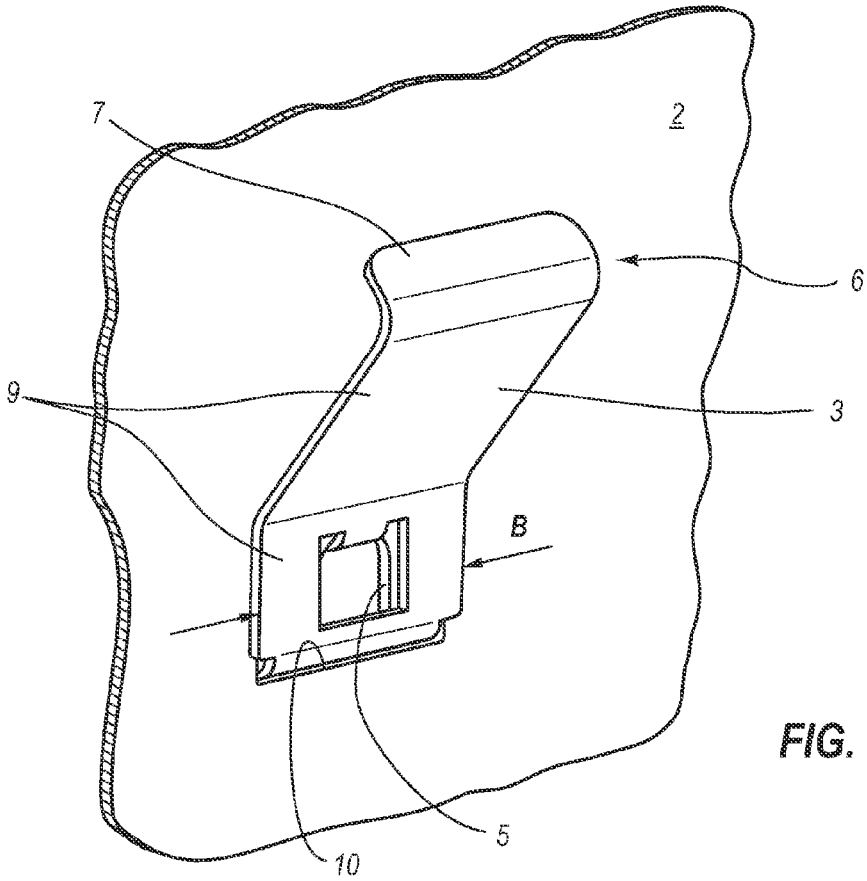
FIG. 4 shows the arrangement according to FIG. 3, viewed from the other side of the supporting element.

As may be seen in FIG. 3, the end of the locking element 4 is in this case widened, i.e. it has a widening 11, so the locking element 4 has a T-shaped contour. The widening 11 of this resilient end of the locking element 4 reaches, while the spring 3 pivots during mounting, behind the recess 5 and then engages in such a way that the spring 3 is secured and fixed to the supporting element 2. In order to simplify the mounting process, the widening 11 can have lateral bevels 14 (insertion bevels) (see FIG. 3).

An optimum fit of the spring 3 which is mounted on the supporting element 2 is achieved if the fixed end 8 of the spring 3 has an offset t relative to the region 9 which is bent in a leaf-shaped manner, i.e. if the portion 8 is offset relative to the portion 9 of the spring 3 by an amount t in the normal direction N of the spring basic part. In the exemplary embodiment, the offset t corresponds—as may be seen in FIG. 1—precisely to the thickness of the supporting element 2.

The spring 3 can be fixed in its mounting end position by means of the described configuration without mounting tools in that the spring is pivoted about the axis 12 and then clipped in by means of the locking element 4.

The shaping of the spring 3 allows it to be used for any desired installation situations, i.e. in the event of variations in the depth of the protective casing or in the worktop appropriate adaptation can easily ensure that the cooking hob to be held or to be secured comes to lie in the correct position.

The described geometric embodiment of the spring 3, with the bending configured through the offset t and the locking element 4 which is embodied as a snap hook, allows the manufacture and the mounting at low cost of a reliable fastening element which is suitable for a large number of cooking hobs to be secured.

LIST OF REFERENCE NUMERALS

1 Fastening element
2 Supporting element
3 Spring
4 Locking element
5 First recess
6 Free end of the spring
7 Gripping portion
8 Fixed end of the spring
9 Region which is bent in a leaf-shaped manner
10 Second slit-shaped recess
11 Widening
12 Axis
13 Window
14 Bevel
B Width of the region which is bent in a leaf-shaped manner
b Reduced width
$B_s$ Width of the second slit-shaped recess
D Diameter
N Normal direction
t Offset

We claim:

1. A combination of a fastening element and a supporting element, comprising:

the fastening element for attaching a part, such as a cooking hob, to the supporting element, such as a frame supporting or surrounding the cooking hob;

whereby the fastening element comprises a spring configured to be secured to the supporting element by a locking element which is disposed on the spring and which engages into a first recess in the supporting element;

wherein:

an end of the spring, which is free from contact with the supporting element when the spring is mounted to the supporting element, has a gripping portion for holding the part;

the spring is embodied as an element which is bent in a leaf-shaped manner;

another end of the spring, which is remote from the free end, has a width which is reduced in relation to a width of a region of the spring which is bent in a leaf-shaped manner;

the width-reduced end of the spring penetrates in a second slit-shaped recess in the supporting element when the spring is mounted to the supporting element; and a width of the second slit-shaped recess is smaller than the width of the region of the spring that is bent in a leaf-shaped manner.

2. The combination of a fastening element and a supporting element as claimed in claim 1, wherein the spring consists of a strip-like piece of spring steel.

3. The combination of a fastening element and a supporting element as claimed in claim 1, wherein the locking element which is disposed on the spring is formed from the material of the spring.

4. The combination of a fastening element and a supporting element as claimed in claim 1, wherein the locking element is formed by a portion which is punched out of the material of the spring and bent out of the plane of the metal sheet.

5. The combination of a fastening element and a supporting element as claimed in claim 4, wherein the locking element has a widening in its end region which is remote from the basic element of the spring.

6. The combination of a fastening element and a supporting element as claimed in claim 5, wherein the widening is T-shaped in its embodiment.

7. The combination of a fastening element and a supporting element as claimed in claim 1, wherein the first and the second slit-shaped recess in the supporting element merge and form a single material cutout in the supporting element.

8. The combination of a fastening element and a supporting element as claimed in claim 7, wherein the first recess is embodied in a semicircular shape adjoining the second slit-shaped recess.

9. The combination of a fastening element and a supporting element as claimed in claim 8, wherein the diameter of the semicircle is between 25% and 70% of the width of the second slit-shaped recess.

10. The combination of a fastening element and a supporting element as claimed in claim 1, wherein the reduced width of the end which is remote from the free end of the spring is between 75% and 90% of the width of the region of the spring that is bent in a leaf-shaped manner.

11. The combination of a fastening element and a supporting element as claimed in claim 1, wherein the end which is remote from the free end of the spring is disposed offset relative to the region of the spring that is bent in a leaf-shaped manner in the normal direction of the region.

12. The combination of a fastening element and a supporting element as claimed in claim 11, wherein the offset is between 0.5 mm and 2.0 mm.

13. The combination of a fastening element and a supporting element as claimed in claim 11, wherein the offset corresponds to the thickness of the supporting element.

14. The combination of a fastening element and a supporting element as claimed in claim 11, wherein the offset is generated by a process of reshaping the spring metal sheet which is flat in its initial state.

15. A combination of a fastening element and a supporting element, the fastening element for attaching a part such as a cooking hob to the supporting element, such as a frame supporting or surrounding the cooking hob, comprising:

a spring configured to be secured to the supporting element by engaging a locking element which is disposed on the spring into a first recess in the supporting element wherein:

the spring has at its one end which is free in the mounted state a gripping portion for holding the part and the spring is embodied as an element which is bent in a leaf-shaped manner;

the spring has at the other end which is remote from the free end a width which is reduced in relation to a width of a region which is bent in a leaf-shaped manner;

the width-reduced end penetrates in the mounted state of the spring a second slit-shaped recess in the supporting element;

a width of the second slit-shaped recess is smaller than the non-reduced width of the region of the spring that is bent in a leaf-shaped manner;

the locking element is formed by a portion which is punched out of the material of the spring and bent out of the plane of the metal sheet; and the locking element has a widening in its end region which is remote from the basic element of the spring.

16. The combination of a fastening element and a supporting element as claimed in claim 15, wherein the widening is T-shaped in its embodiment.

17. A combination of a fastening element and a supporting element, the fastening element for attaching a part such as a cooking hob to the supporting element, such as a frame supporting or surrounding the cooking hob, comprising:

a spring configured to be secured to the supporting element by engaging a locking element which is disposed on the spring into a first recess in the supporting element wherein:

the spring has at its one end which is free in the mounted state a gripping portion for holding the part and the spring is embodied as an element which is bent in a leaf-shaped manner;

the spring has at the other end which is remote from the free end a width which is reduced in relation to a width of a region which is bent in a leaf-shaped manner;

the width-reduced end penetrates in the mounted state of the spring a second slit-shaped recess in the supporting element;

a width of the second slit-shaped recess is smaller than the non-reduced width of the region of the spring that is bent in a leaf-shaped manner; and the first and the second slit-shaped recess in the supporting element merge and form a single material cutout in the supporting element.

18. The combination of a fastening element and a supporting element as claimed in claim 17, wherein the first recess is embodied in a semicircular shape adjoining the second slit-shaped recess.

19. The combination of a fastening element and a supporting element as claimed in claim 18, wherein the diameter of the semicircle is between 25% and 70% of the width of the second slit-shaped recess.

20. A combination of a fastening element and a supporting element, the fastening element for attaching a part such as a cooking hob to the supporting element, such as a frame supporting or surrounding the cooking hob, comprising:

a spring configured to be secured to the supporting element by engaging a locking element which is disposed on the spring into a first recess in the supporting element wherein:

the spring has at its one end which is free in the mounted state a gripping portion for holding the part and the spring is embodied as an element which is bent in a leaf-shaped manner;

the spring has at the other end which is remote from the free end a width which is reduced in relation to a width of a region which is bent in a leaf-shaped manner;

the width-reduced end penetrates in the mounted state of the spring a second slit-shaped recess in the supporting element;

a width of the second slit-shaped recess is smaller than the non-reduced width of the region of the spring that is bent in a leaf-shaped manner; and the reduced width of the end which is remote from the free end of the spring is between 75% and 90% of the width of the region of the spring that is bent in a leaf-shaped manner.

* * * * *